US010046573B2

(12) United States Patent
Marciano

(10) Patent No.: US 10,046,573 B2
(45) Date of Patent: Aug. 14, 2018

(54) SUCTION BOX, SYSTEM FOR CONVEYING FLAT MEDIA, AND PRINTING MACHINE THUS EQUIPPED

(71) Applicant: BOBST MEX SA, Mex (CH)

(72) Inventor: Pascal Marciano, Bussigny (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 15/325,748

(22) PCT Filed: Jul. 15, 2015

(86) PCT No.: PCT/EP2015/025049

§ 371 (c)(1),
(2) Date: Jan. 12, 2017

(87) PCT Pub. No.: WO2016/008596

PCT Pub. Date: Jan. 21, 2016

(65) Prior Publication Data

US 2017/0157955 A1 Jun. 8, 2017

(30) Foreign Application Priority Data

Jul. 18, 2014 (EP) ..... 14002498

(51) Int. Cl.
*B41J 2/01* (2006.01)
*B41J 11/00* (2006.01)
*B41J 29/13* (2006.01)

(52) U.S. Cl.
CPC ..... *B41J 11/0085* (2013.01); *B41J 11/007* (2013.01); *B41J 29/13* (2013.01)

(58) Field of Classification Search
CPC ... B41J 11/007; B41J 11/0085; B41J 11/0025; B41J 13/103; B41J 29/13; B41F 15/20; B41F 1/32; B41F 21/08; B65H 11/005
(Continued)

(56) References Cited

U.S. PATENT DOCUMENTS 3,527,166 A 9/1970 Jaffa et al.
6,471,430 B1 10/2002 Gaus et al.
2007/0247505 A1* 10/2007 Isowa ..... B41J 3/407 347/101

FOREIGN PATENT DOCUMENTS

EP 1 847 397 A2 10/2007
JP 2005-096135 4/2005
(Continued)

OTHER PUBLICATIONS

International Search Report dated Oct. 22, 2015 issued in corresponding International patent application No. PCT/EP2015/025049.

*Primary Examiner* — Jannelle M Lebron
(74) *Attorney, Agent, or Firm* — Ostrolenk Faber LLP

(57) ABSTRACT

A suction box for a system for transporting flat media (4) includes at least one endless belt (6), formed with a plurality of through-holes, used in a media printing machine (1) equipped with at least one printing unit (2). The suction box includes a suction device (23) to generate a vacuum, a suction compartment (16), divided into at least two distinct chambers (26, 27, 28), including a first suction chamber (28) of variable volume, in communication with the suction device (23) so as to apply the vacuum through the holes in the belt (6) to the media being transported by the belt (6), and a second chamber (26, 27) at ambient pressure. The first and second chambers (28, 26, 27) are separated from one another by a mobile partition (31, 33). The suction compartment (16) has an open upper face equipped with a holding arrangement (14, 43, 44, 46, 47, 48) allowing movement of the belt (6).

14 Claims, 6 Drawing Sheets

(58) Field of Classification Search
USPC ..... 347/16, 101, 104; 101/474; 400/624
See application file for complete search history.

(56) References Cited

FOREIGN PATENT DOCUMENTS

| | | |
|---|---|---|
| JP | 2010-149310 | 7/2010 |
| JP | 2013-132789 | 7/2013 |

* cited by examiner

SUCTION BOX, SYSTEM FOR CONVEYING FLAT MEDIA, AND PRINTING MACHINE THUS EQUIPPED

CROSS-REFERENCE TO RELATED APPLICATIONS

The present application is a 35 U.S.C. §§ 371 national phase conversion of PCT/EP2015/025049, filed Jul. 15, 2015, which claims priority of European Patent Application No. 14002498.5, filed Jul. 18, 2014, the contents of which are incorporated by reference herein. The PCT International Application was published in the French language.

TECHNICAL BACKGROUND

The present invention relates to a suction box for a system for conveying flat media in a printing machine for flat media. The invention relates to a system for conveying flat media comprising at least one suction box. The invention also relates to a printing machine for flat media, equipped with a system for conveying flat media, and the system comprising at least one suction box.

A printing machine is used in the packaging industry for printing flat media such as sheets or a web of paper or cardboard. The machine comprises several stations in succession. A first infeed station, situated furthest upstream, inputs the medium in succession. The infeed station supplies several printing stations, in the form of one or more printing units placed one after the other. Each printing unit prints a specific color using an ink which has the equivalent coloration. The machine can easily accept different sizes of medium. A delivery station which collects the medium which has been printed with an image is provided at the end of the machine.

In the case of printing sheets of cardboard, particularly corrugated cardboard, the technology used most frequently is flexography using a flexo unit. Digital printing is also developing, with the use of printing units equipped with digital print heads, for example of the inkjet-type. This printing technology enables the packaging manufacturer to change print jobs very quickly in order to print new sheets from a computer file representing the packaging.

The printing machine comprises one or more printing units with the number of units depending on the number of colors desired. The medium is moved longitudinally from upstream to downstream from the infeed station, to the printing units and as far as the delivery station. In order to obtain a final high-quality image on the printed medium, it is in particular necessary that all the printed dots of different colors be placed exactly next to one another. It is also necessary that the printed dots not be deformed.

The printing quality obtained on the flat medium depends not only on the quality of the printing machines, the quality of the inks used and the quality of the media input, but also on the quality and accuracy of the conveying system or systems used.

The medium is conveyed by a vacuum conveying system using a belt, flat straps, or steel rolls driven in order to move the medium longitudinally from one printing unit to another, upstream to downstream, from the infeed station to the delivery station. In order to obtain optimal print quality, one of the fundamental principles is that the medium is conveyed at a speed which is as uniform as possible. Another principle is that the medium must be held as firmly as possible and must be guided perfectly by the conveying system so that there is no deviation during the printing by the printing unit or units or between the printing unit or units.

PRIOR ART

U.S. Pat. No. 6,471,430 describes a printing machine for media in the form of sheets of paper or cardboard, comprising a conveying system. For the printing, the sheets are taken from a sheet feeder and conveyed on a first endless conveying belt. The sheets are held in place while they are being conveyed by a suction system and the sheets pass under first printing units and under a first ink dryer downstream from the first printing units. The sheets are then turned over and are conveyed by a second endless conveying belt under second printing units and under a second ink dryer and are then collected in an output station.

The conveying belts include a series of through holes which enable air to be sucked through the belts and the holding effect obtained allows the sheets to be conveyed inside the machine. Suction boxes are placed beneath the belts in order to generate the vacuum.

However, the use of a suction system for applying a vacuum beneath the conveying belt and thereby holding the sheets to be printed flat has certain disadvantages. The vacuum created has an effect on the sheets and more precisely on the position of the guided sheets. This can have consequences for the printing process because parasitical air flows are generated at the front, rear, and side edges of the sheets.

The vacuum also generates disruption in the region of the dryers. Indeed, these dryers comprise a suction part which is required to suck up the moisture generated during the drying. In order to perform optimal drying, the suction takes place from the printed face of the sheets and upwards. However the presence of two vacuums in opposite directions, both beneath in order to hold the sheets in place on the belt and above in order to dry the sheets, will affect the flatness of the sheets and the accuracy of the conveying.

SUMMARY OF THE INVENTION

A main object of the present invention is to provide a suction box intended for a system for conveying flat media in a printing machine for flat media. A second object is to provide a suction box for conveying media which are to be printed, which ensures that these media are held satisfactorily on the conveying belt of the conveying system. A third object is to develop a suction box which makes it possible to minimize load losses when a medium is being conveyed. A fourth object is to produce a box wherein disruptions in the belt are kept to a minimum. A fifth object is to adapt a conveying system with an endless belt for printing flat media comprising at least one suction box. A sixth object is to overcome the technical problems mentioned for the boxes and the conveying systems from the prior art. Yet another object is to improve further the print quality for a printing machine for flat media which is equipped with at least one printing unit.

According to an aspect of the present invention, a suction box intended for a system for conveying flat media with at least one endless belt provided with a set of through holes, in a printing machine for media which is equipped with at least one printing unit, comprises:

- a suction device capable of generating a vacuum, and
- a suction compartment which is divided into at least two separate chambers a first suction chamber with an adjustable volume, which communicates with the suction device, to apply the vacuum through the holes of the belt to the media conveyed by the belt, and a second chamber at ambient pressure, wherein the first and second chamber are separated from each other by a movable partition.

The suction box suction compartment has an open upper face equipped with a holding arrangement which permits the movement of the belt.

As a result, the open upper face of the compartment enables the vacuum to be transferred directly to the belt and thus to the flat media. The belt is held and circulates in the region of the upper face of the compartment.

The suction chamber with adjustable dimensions allows the intensity of the vacuum applied to be adjusted easily and simply. The face along which the belt passes thus has a suction zone which can be varied depending on the adjustable chambers. This makes it possible to maintain a high and optimal suction in the region of the suction zone or zones in order to preserve the flatness of the flat media, the lack of movement of the flat media relative to the conveying belt zones, and hence the accuracy of the conveying.

The surface of this zone varies, for example, depending on the size of the flat media which are to be conveyed and printed. The operation of the printing machine for media will be optimal, the vacuum being applied directly beneath the conveying belt, the extent of which is limited to the zone in which the conveyed flat medium is situated. The size of the chambers supplying the vacuum beneath the conveyed media will be adapted so as not to disrupt the operation of the dryers.

A flat medium is defined, by a non-limiting example, as being made from a material in the form of a sheet, a board, or a continuous strip such as paper, flat cardboard, corrugated cardboard, laminated corrugated cardboard, flexible plastic, for example polyethylene (PE), polyethylene tetraphthalate (PET), bi-oriented polypropylene (BOPP), or other polymers, or still other materials. The flat medium is defined, by a non-limiting example, as being a sheet intended to be formed into a blank and the blank into a packaging box.

The longitudinal direction is defined with reference to the trajectory of the flat medium within the printing machine, along its central longitudinal axis. The upstream and downstream directions are defined with reference to the direction of movement in the trajectory of the medium, in the longitudinal direction of the overall printing machine.

In another aspect of the invention, a system for conveying flat media with at least one endless belt provided with a set of through holes, in a printing machine for the media which is equipped with at least one printing unit, comprises at least one suction box having one or more of the technical features described below.

In another aspect of the invention, a printing machine for flat media, which is equipped with at least one printing unit, comprises a system for conveying the media, comprising at least one suction box having one or more of the technical features described below.

According to yet another aspect of the invention, a printing machine for flat media, which is equipped with at least one printing unit, comprises a system for conveying the media having one or more of the technical features described below.

BRIEF DESCRIPTION OF THE DRAWINGS

The invention will be readily understood and its various advantages and different features will become more apparent from the following description of the non-limiting exemplary embodiment, with reference to the attached schematic drawings, in which.

DESCRIPTION OF PREFERRED EMBODIMENTS

Figure 1:
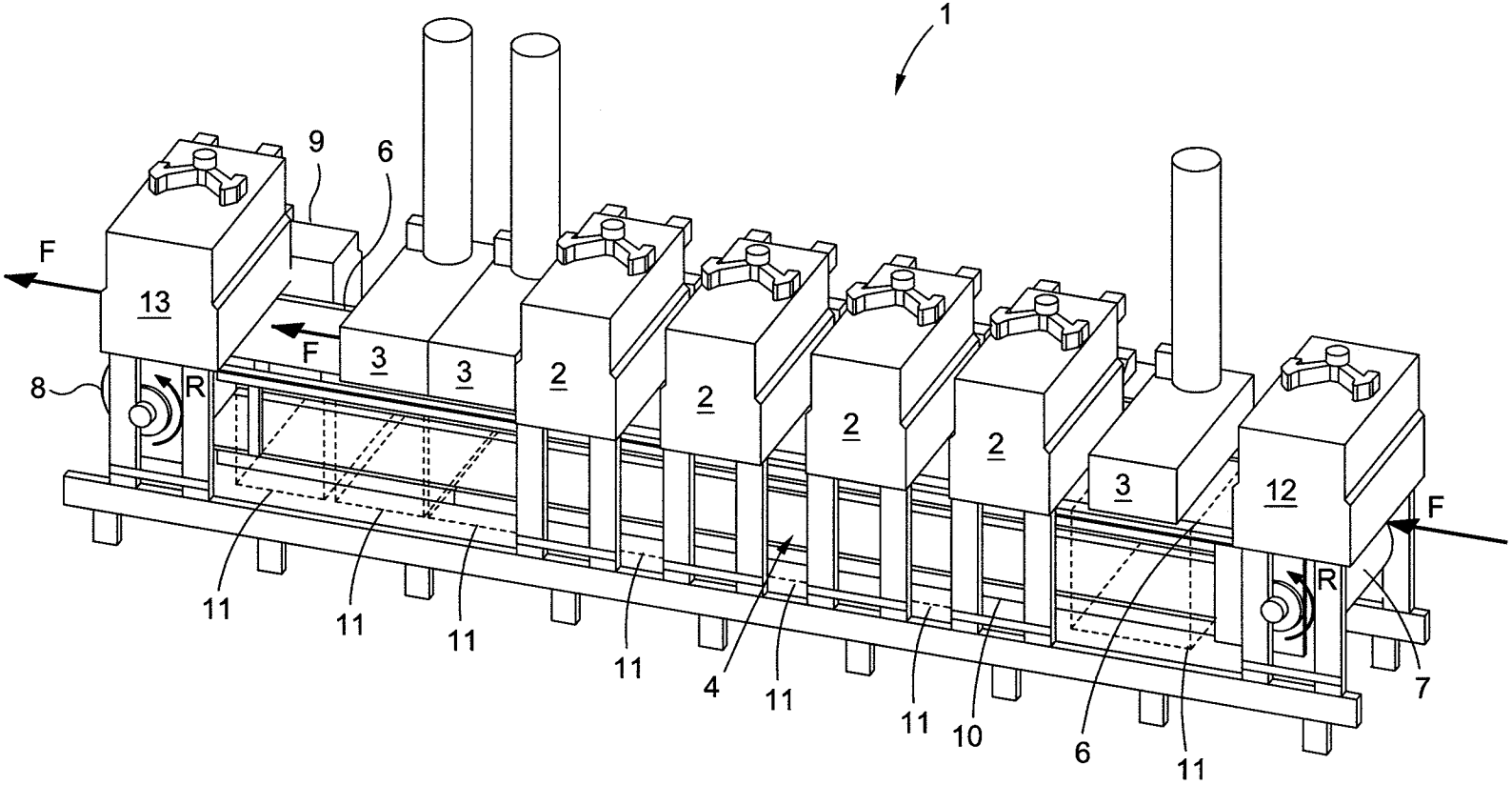
FIG. 1 shows a perspective view of a printing machine, comprising a conveying system and suction boxes according to the invention.

As illustrated in FIG. 1, a printing machine 1 is used for printing media in the form of plate-like elements, for example sheets of corrugated cardboard. In the main exemplary embodiment, the machine 1 is a digital printing machine which includes, for example, some constituent parts described in U.S. Pat. No. 6,471,430 incorporated herein by reference. The machine 1 comprises in particular a set of four printing units 2 arranged in a line, one after the other.

Each of the printing units 2 is equipped with at least one digital contactless print head, for example an inkjet print head. By way of example, a set of heads is directed downward, so that the upper faces of the sheets conveyed by the belt 6 are then printed. The black, cyan, magenta and yellow inks are successively printed by the printing units 2 onto the sheets.

The sheets are input (arrows F in FIG. 1) by a feed station (not shown), mounted upstream from the printing machine 1 (not shown). The sheets are then gripped, are conveyed, circulate longitudinally F, and are output F after they are printed at a delivery station (not shown), mounted downstream from the printing machine 1. Two dryers 3, with steam discharge tubes, are placed downstream from the printing units 2.

The sheets which are to be printed are conveyed from upstream to downstream by a conveying system 4. The conveying system 4 comprises at least one belt, in this case a single endless metal belt 6 which is mounted between a first upstream roller 7 and a second downstream roller 8. The endless belt 6 is provided with a set of through holes (not visible in FIG. 1). At least one of the two rollers 7 and 8 is driven in rotation (arrow R in FIG. 1) by means of a motor 9, which drives the belt 6. The rollers 7 and 8 and the belt 6 are mounted on a frame 10.

The sheets remain applied flat on the belt 6 by virtue of suction boxes which are also called vacuum boxes 11 located below the belt 6, and the sheets pass beneath the printing units 2 and dryers 3. Only the vacuum boxes 11 at one of upstream from the printing units 2, between the printing units 2, and downstream from the printing units 2 are shown in dashed lines in FIG. 1.

In order to promote the adhesion and stability of the inks which will be deposited by printing on the cardboard sheets which are to be printed, the printing machine 1 preferably comprises an upstream coating unit 12 arranged upstream from the first printing unit 2 and just after the feed station. The upstream coating unit 12 is placed at a right angle to the upstream roller 7. In order to dry the coating, a dryer 3 may be interposed between the upstream coating unit 12 and the first printing unit 2.

In order to promote stability and protection of the inks which are deposited by printing on the cardboard sheets which have been printed, the printing machine 1 preferably comprises an upstream coating unit 12. A downstream coating unit 13 is arranged downstream from the last printing unit 2 and downstream from the dryers 3, just before the delivery station. The downstream coating unit 13 is placed at a right angle to the downstream roller 8.

Seven suction boxes 11 are mounted on the frame 10 under the belt 6. The boxes 11 are situated between the upper part of the belt run of the belt 6 which conveys the sheets and the lower part of the belt run of the belt 6 which makes the return travel. Each suction box 11 comprises an upper face oriented toward the lower face of the belt 6. The sheets are applied flat against the top face of the belt 6. The belt 6 passes in the region of the upper face of each suction box. Each of the dryers 3 is associated with a suction box 11. Each gap between the printing units 2 is associated with a suction box 11.

The box 11 according to a first embodiment comprises, in the region of the upper face, an arrangement for holding the belt 6 in place, comprising a series of transverse, equidistant, and mutually parallel rolls 14 (FIGS. 2, 3, 4 and 5). For clarity, the central roll 14 has been removed for the box 11 shown in FIG. 3. The rolls 14 are held so that they are free to rotate by means of bearings. The rolls 14 are flush with the upper face of the compartment 16. The belt 6 is moved on the rolls 14, which limits friction and vibration.

The suction box 11 comprises (FIGS. 2 and 3) a suction compartment 16, delimited by two upstream and downstream side walls 17 and 18, two front and rear longitudinal walls 19 and 21, and a base 22. For clarity, the front wall 19 has been removed for the box 11 shown in FIG. 4. The box 11 with the suction compartment 16 has an open upper face.

The box 11 with its compartment 16 communicates with a suction device 23 comprising, for example, a motor 24 capable of generating a vacuum in the compartment 16.

The compartment 16 is divided into at least two chambers. In this case, three chambers 26, 27 and 28 are included. A second front chamber 26 and a second rear chamber 27 surround a first central suction chamber 28. The central chamber 28 is adjustable and has a variable pressure capacity which is selected by the operator. The two front and rear chambers 26 and 27 remain at ambient pressure.

The central chamber 28 communicates with the suction device 23 to apply vacuum through the holes of the belt 6 and to the media conveyed by the belt 6. In the center of the box 11, of the compartment 16, and hence of the central chamber 28 is situated an opening 29 which is connected to the suction device 23 used to create the vacuum.

The central chamber 28 is delimited by two movable partitions 31 and 33. A front movable partition 31 separates the second front chamber 26 from the first central chamber 28. A rear movable partition 33 separates the second rear chamber 27 from the first central chamber 28. The suction box 11 is adjustable to the size of the conveyed sheet. Flexible plastic seals or skirts (which cannot be seen) ensure that the central chamber 28 is leakproof by rubbing against the upstream and downstream side walls 17 and 18 and against the base 22.

The central chamber 28 and the chambers at ambient pressure 26 and 27 are preferably oriented longitudinally, and the movable partitions 31 and 33 are oriented longitudinally overall, from upstream to downstream.

Figure 3:
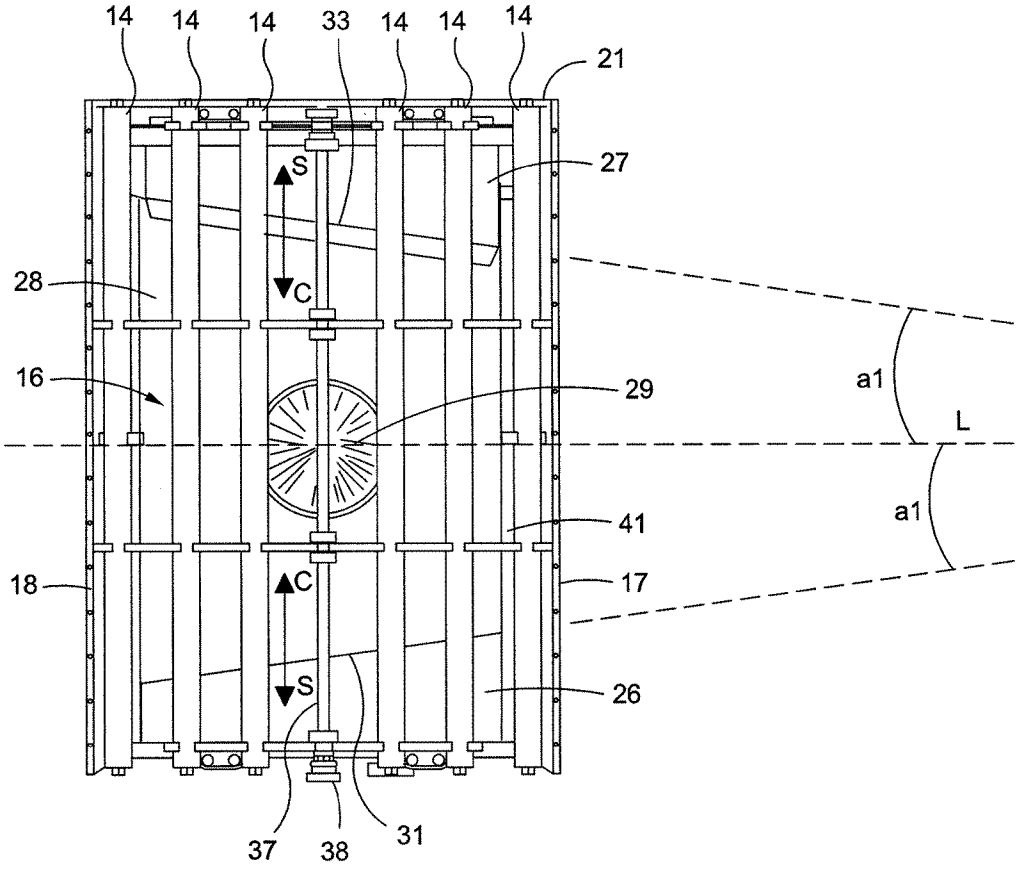

The movable partitions 31 and 33 diverge from each other, each being advantageously being inclined with respect to the other. As can be seen in FIG. 3, the partitions 31 and 33 are favorably inclined relative to each other (at angles a1) with respect to a central longitudinal vertical plane passing through the central longitudinal axis L of the box 11 and the machine 1. In such a configuration, it becomes impossible to completely close the central chamber 28 between the two movable partitions 31 and 33. The partitions have a V-shaped configuration when seen from above, when they are close to each other, which makes it possible to prevent the opening 29 of the suction means 23 from being blocked.

Figure 2:
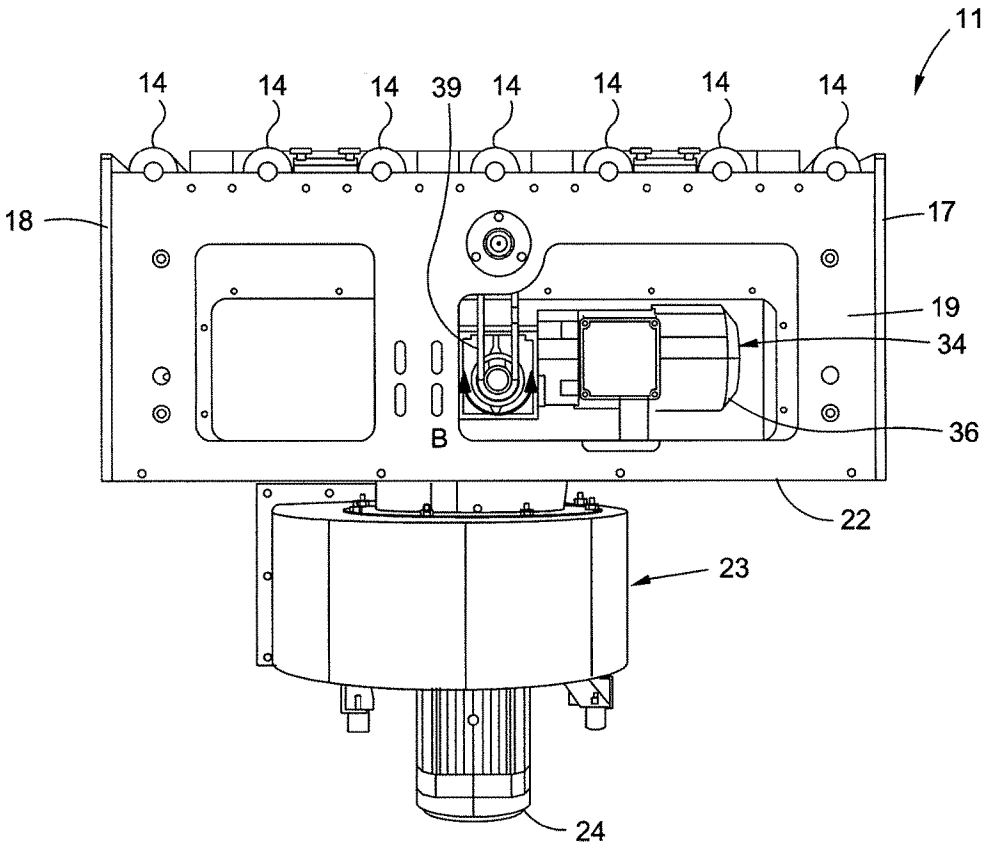
FIGS. 2 to 5 each show respectively a side view, a plan view, a plan perspective downstream view, and a plan perspective upstream view of a suction box according to a first embodiment of the invention.
Figure 4:
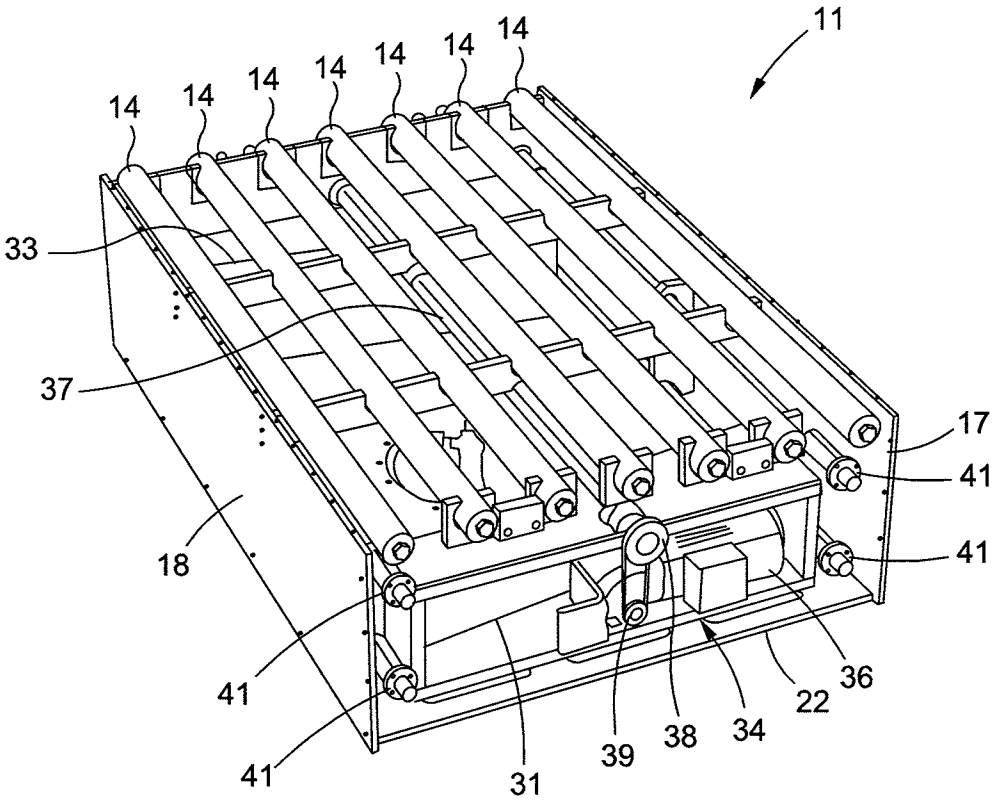
Figure 5:
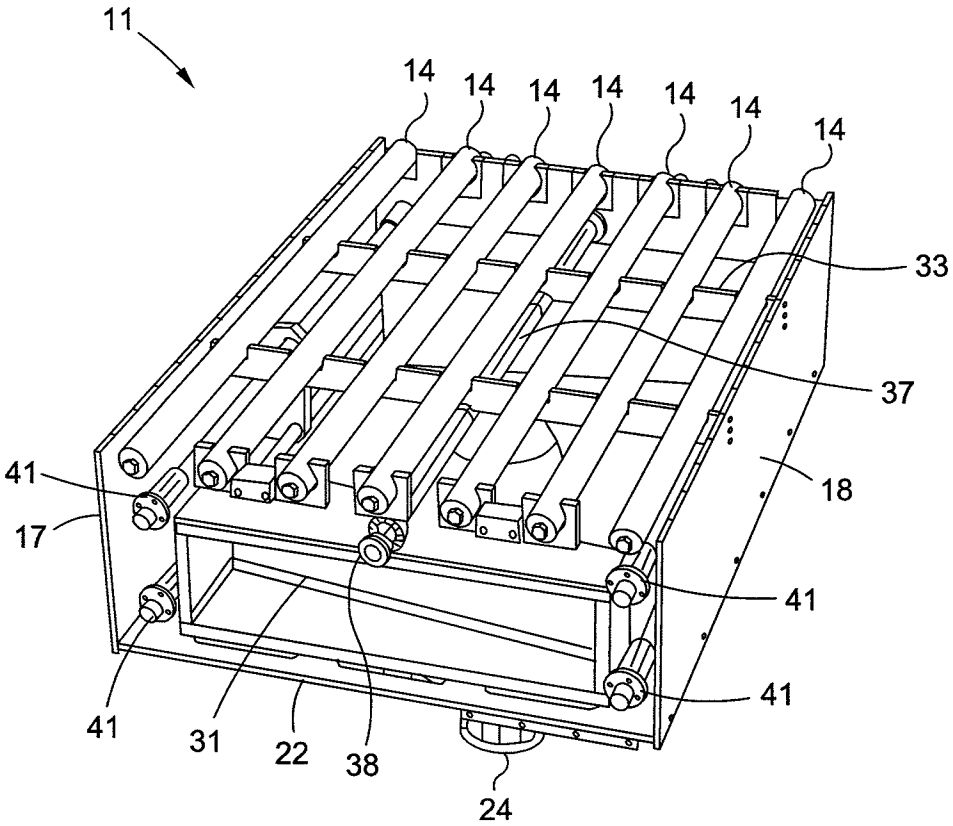

The box 11 preferably comprises an actuation device 34 for the two movable partitions 31 and 33 (see FIGS. 2 and 4). The actuation device 34 preferably comprise at least one motor, in this case a single motor 36 which actuates and moves the two partitions 31 and 33 in translation. The motor 36 is installed in a housing situated behind the front wall 19. This housing is particularly advantageous as it allows the motor 36 to be added inside the volume of the suction box 11 rather than outside it.

The actuating device 34 can comprise an endless screw 37. The screw 37 extends transversely through the compartment 16 substantially in its center. The screw 37 is held in rotation by means of bearings. The screw 37 traverses each of the two movable partitions 31 and 33 with the aid of a piece forming a slide.

A cog 38 is fixed to the endless screw 37 at its front end. The motor 36 is mechanically connected to a drive, such as a chain or a belt 39, which causes the endless screw 37 to rotate (arrows A and B in FIG. 2) via the cog 38.

The rotation of the endless screw 37 enables bringing the partitions 31 and 33 closer together or further apart, depending on the direction of rotation of the screw 37. The two partitions 31 and 33 are favorably positioned symmetrically relative to each other. The two partitions 31 and 33 move transversely from front to back and vice versa (arrows C and S in FIG. 3), symmetrically relative to each other.

The box 11 preferably comprises a guide device for each of the movable partitions 31 and 33. The guide device may have the form of guide bars 41. The bars 41 extend transversely through the compartment 16 substantially in the region of the upstream and downstream side walls 17 and 18. Four bars 41 are provided, including an upstream upper bar, an upstream lower bar, a downstream upper bar, and a downstream lower bar.

Figure 6:
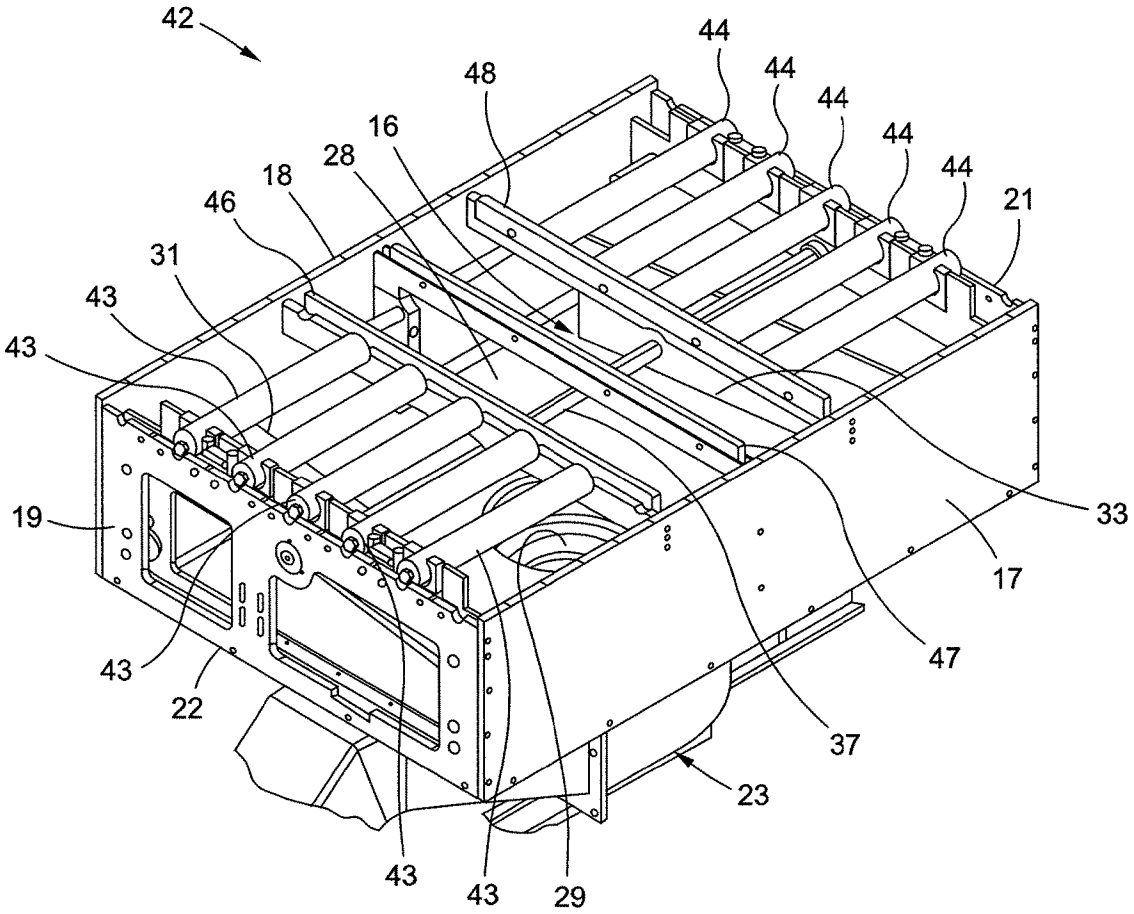
FIG. 6 shows a plan perspective upstream view of a suction box according to a second embodiment of the invention.

In a second embodiment of the invention (see FIG. 6), a suction box 42 comprises the suction compartment 16, delimited by the two upstream and downstream side walls 17 and 18, the two front and rear longitudinal walls 19 and 21, and the base 22. The box 42 and the suction compartment 16 have an open upper face.

The box 42 with its compartment 16 communicates with a suction device 23. In the center of the box 42, of the compartment 16, and hence of the central chamber 28 is situated an opening 29 which is connected to the suction device 23 used to create vacuum in the central chamber. The two partitions 31 and 33 used are substantially similar to those of the first embodiment in design and operation.

The box 42 according to the second embodiment comprises, in the region of the upper face, an arrangement for holding the belt 6, comprising a first series of front rolls 43. These front rolls 43, for example five in number, are transverse to the belt, equidistant from each other, and mutually parallel. The arrangement for holding the belt 6 also comprises a first series of rear rolls 44. These rear rolls 44, for example five in number, are also transverse to the belt, equidistant, and mutually parallel. The front 43 and rear 44 rolls are held such that they are free to rotate by means of bearings. The front rolls 43 are situated in line with the rear rolls 44.

The holding arrangement comprises three runners arranged longitudinally, a front runner 46, a central runner 47, and a rear runner 48. The front rolls 43 are separated from the rear rolls 44 by the runners 46, 47 and 48. The upper edges of these runners 46, 47 and 48 are flush with the upper face of the compartment 16.

The belt 6 is moved, while it is held on the front 43 and rear 44 rolls. The central part of the belt 6 slides on the upper edge of these runners 46, 47 and 48. Because the belt 6 is held by the series of rolls 43 and 44 and by the runners 46, 47 and 48, it makes it possible to prevent the belt 6 from vibrating and consequently from disrupting the printing of the sheets by the printing units 2.

It is also possible to use such a box 11 in other parts of the printing machine 1, for example beneath the printing units 2 or other modules. Alternatively, one motor can be provided per partition 31 and 33 with independent actuation means (endless screw or other means) for each motor/movable partition pair.

The present invention is not limited to the embodiments described and illustrated. Numerous modifications can be made without in so doing going beyond the scope of the claims.

The invention claimed is:

1. A suction box and endless belt combination for use in a system for conveying flat media:

the combination of the suction box and the endless belt is configured for installation in a printing machine for printing media, wherein the machine is equipped with at least one printing unit for printing the media;

the suction box and endless belt combination comprising:

an endless belt configured for conveying flat media then on the belt, the belt being provided with a plurality of through holes;

a suction box having a suction device configured for generating a vacuum in the suction box;

the suction box having a suction compartment;

the suction compartment having an open upper face and the upper face is equipped with a holding arrangement for holding the belt at the open upper face of the suction box while permitting movement of the belt past the open upper face for conveying the media on the belt;

the suction compartment being divided into at least a first chamber and a second separate chamber;

the first chamber of the suction compartment being configured to be adjustable in volume, the first chamber of the suction compartment communicates with the suction device to apply the generated vacuum through the holes in the belt and to the flat media to be conveyed by the belt; and the second chamber of the suction compartment is at an ambient pressure;

a movable partition separating the first and second separate chambers from each other; wherein the first chamber comprises a centrally located suction chamber;

two of the second chambers are disposed at different respective sides of the first suction chamber, and the second chambers are held at ambient pressure;

wherein the first suction chamber is delimited from the two second chambers by two spaced apart and movable partitions which are movable relatively, and configured and movable to adjust the volume of the first suction chamber; and the partitions are inclined relative to each other with respect to a central longitudinal vertical plane.

2. A combination according to claim 1, wherein the holding arrangement for the belt comprises at least one roll over which the belt passes as it conveys the media on the belt.

3. A combination according to claim 2, further comprising the holding arrangement comprises at least one runner over which the belt passes as it conveys the media on the belt.

4. A combination according to claim 1, further comprising an actuating device for actuating the partition, the actuating device comprising at least one motor and an endless screw driven to rotate by the motor and the screw is configured to move the partition by the rotation of the screw.

5. A combination according to claim 1, further comprising a guide device for guiding movement of the partition.

6. A combination according to claim 1, further comprising the two partitions are positioned and are configured to move symmetrically relatively toward and away from each other.

7. A combination according to claim 1, wherein the first suction chamber, and the second chamber at ambient pressure, are oriented longitudinally to movement of the media on the belt.

8. A combination according to claim 1, further comprising the first chamber comprises a centrally located first suction chamber, and two of the second chambers at different locations outside the first chamber, and held at ambient pressure, wherein the first suction chamber is delimited from the second chambers by two spaced apart movable partitions movable relatively and configured and movable to adjust the volume of the first suction chamber.

9. A printing machine for flat media comprising at least one printing unit, and comprising a system for conveying the media, and comprising at least one suction box and endless belt combination according to claim 1.

10. A system for conveying flat media in a printing machine which prints the media, the system comprising:

at least one printing unit configured for printing the flat media being conveyed past the printing unit;

an endless belt configured for conveying flat media then on the belt, the belt being provided with a plurality of through holes permitting suction by vacuum through the holes in the belt to hold the media to the belt by the suction; and at least one suction box and endless belt combination according to claim 1, with the open face of the suction box located for applying suction at the belt for holding the flat media to the belt during conveying of the media.

11. A system according to claim 10, further comprising first and second rollers between which the endless belt is mounted and conveys the media; and at least one drive motor by which the rollers are driven in rotation for driving the belt in a direction of conveying the media.

12. A printing machine for flat media comprising at least one printing unit, and a system for conveying the media, according to claim 10.

13. A printing machine according to claim 12, further comprising a dryer associated with the suction box for drying media conveyed past the suction box.

14. A printing machine according to claim 12, wherein the printing unit is equipped with at least one digital print head for printing on the media.

* * * * *